United States Patent [19]

Webster

[11] Patent Number: 4,475,320

[45] Date of Patent: Oct. 9, 1984

[54] METHOD FOR REGRINDING STEP DRILLS

[75] Inventor: Frank R. Webster, Tukwila, Wash.

[73] Assignee: The Boeing Company, Seattle, Wash.

[21] Appl. No.: 375,800

[22] PCT Filed: Mar. 10, 1982

[86] PCT No.: PCT/US82/00301

§ 371 Date: Mar. 10, 1982

§ 102(e) Date: Mar. 10, 1982

[87] PCT Pub. No.: WO83/03150

PCT Pub. Date: Sep. 15, 1983

[51] Int. Cl.[3] ..... B24B 1/00

[52] U.S. Cl. ..... 51/288; 51/165.72; 51/219 R; 364/474

[58] Field of Search ..... 51/165.72, 288, 94 R, 51/125.5, 219 R, 219 PC, 165.71, 124; 364/474, 475, 563, 550, 560; 356/384, 385, 357, 69, 355; 408/3, 6, 7, 10, 12, 13, 16, 18; 318/640; 33/DIG. 21

[56] References Cited

U.S. PATENT DOCUMENTS

| | | | |
|---|---|---|---|
| 2,564,496 | 8/1951 | Murray | 51/219 PC |
| 2,931,917 | 4/1960 | Beclitz | 356/385 |
| 3,040,480 | 6/1962 | Winslow | 51/219 R |
| 3,209,493 | 10/1965 | Houser | 51/124 R |
| 3,543,445 | 12/1970 | Borchert | 51/124 R |
| 3,851,180 | 11/1974 | Kato | 356/384 |
| 3,947,129 | 3/1976 | Wiklund | 356/385 |
| 4,005,552 | 2/1977 | Hoglund | 51/165.72 |
| 4,167,082 | 9/1979 | Kolb | 51/165.72 |
| 4,176,396 | 11/1979 | Howatt | 364/551 |
| 4,228,514 | 10/1980 | Weiss | 364/551 |
| 4,260,986 | 4/1981 | Kobayashi | 73/104 |

*Primary Examiner*—Harold D. Whitehead

*Attorney, Agent, or Firm*—Conrad O. Gardner; Bernard A. Donahue; Nicolaas DeVogel

[57] ABSTRACT

A drill bit pointer machine includes a laser micrometer for measuring the pilot diameter and transmitting the data to a microprocessor through a digital readout. The microprocessor is programmed to manipulate the data and define the operation of a stepper motor which produces the required motion necessary for adjusting the machine workhead stop for utilization in the subsequently performed semi-automatic grinding cycle.

1 Claim, 1 Drawing Figure

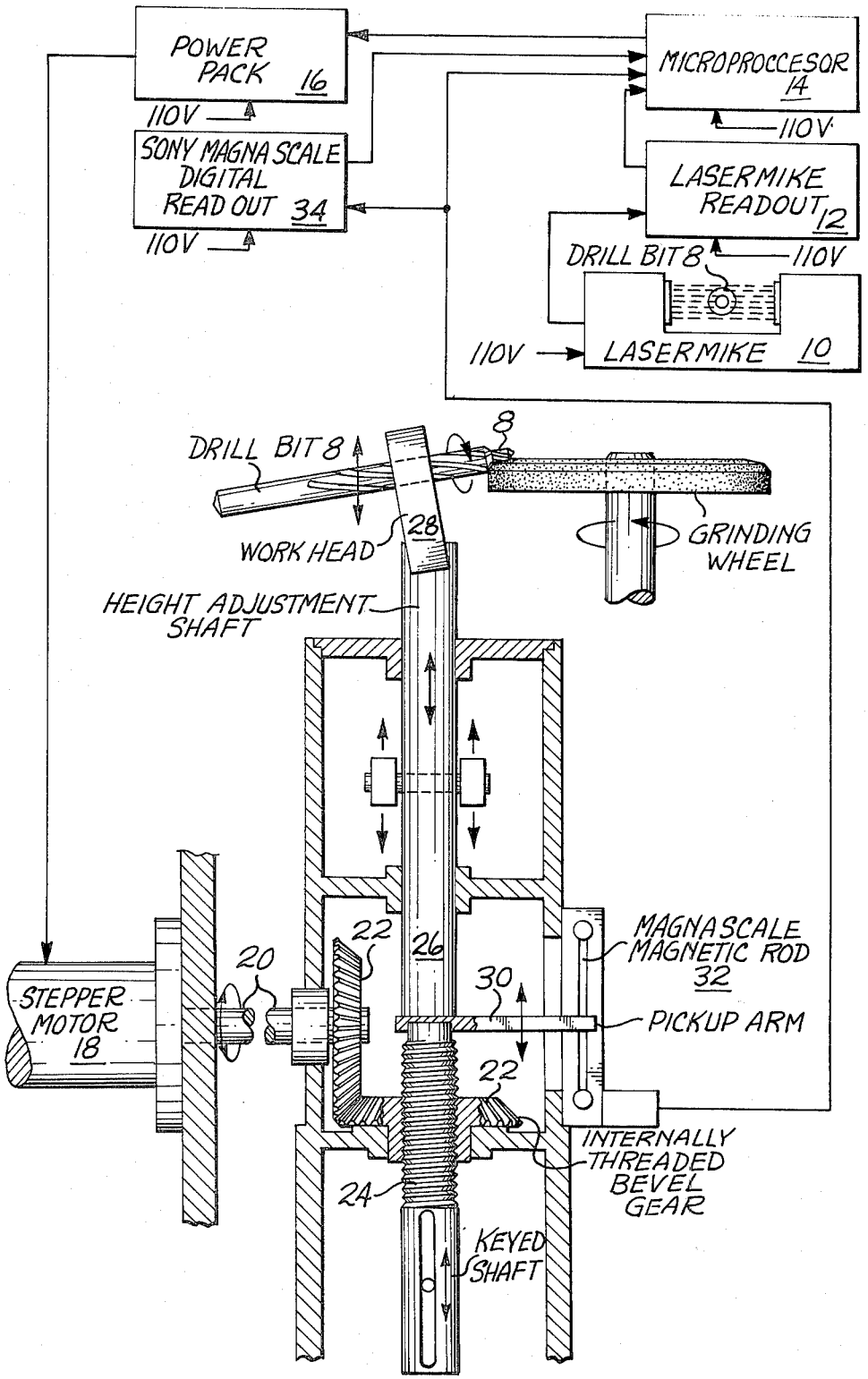
POWER PACK 16
110V
SONY MAGNA SCALE DIGITAL READ OUT 34
110V
MICROPROCCESOR 14
110V
LASERMIKE READOUT 12
DRILL BIT 8
110V
110V
LASERMIKE 10
DRILL BIT 8
8
WORK HEAD
28
GRINDING WHEEL
HEIGHT ADJUSTMENT SHAFT
22
26
20
STEPPER MOTOR 18
30
MAGNASCALE MAGNETIC ROD 32
PICKUP ARM
22
INTERNALLY THREADED BEVEL GEAR
24
KEYED SHAFT

METHOD FOR REGRINDING STEP DRILLS

INTRODUCTION

The present invention relates to an improved method and apparatus for grinding step drills and, more particularly, to a method and apparatus for regrinding step drills utilizing a laser optical microscope sensing system.

BACKGROUND OF THE INVENTION

Heretofore the method of grinding step drills included a ninety percent manual operation wherein fourteen steps in the grinding operation of one step drill were utilized.

In contrast, the present step drill pilot diameter sensing system utilized in regrinding step drills reduces the method to three steps.

DESCRIPTION OF THE PRIOR ART

The prior art patent literature includes U.S. Pat. No. 4,176,396 which teaches the use of a tool water measuring device and control apparatus in which a microprocessor responds to cutting tool profile related signals for manipulating same and providing a digital readout of the tool wear signals and/or supply to the machine tool processor.

BRIEF SUMMARY OF THE INVENTION

In contrast, in accordance with a preferred embodiment of the present method, a three step method includes:

1. positioning the drill in a fixture associated laser optical microscope and switching a measuring switch to the ON position;
2. rotating the drill 360° and switching OFF the measuring switch; and,
3. removing the drill from the fixture and placing the drill in the machine workhead activating the grinder.

A full understanding of the invention, and of its further objects and advantages and the several unique aspects thereof, will be had from the following description when taken in conjunction with the accompanying drawings.

BRIEF DESCRIPTION OF THE DRAWING

The sole FIGURE is a block diagram and partial schematic of the present control system and grinder for measuring the pilot diameter and operating a stepper motor which produces the required motion necessary for adjusting the machine workhead stop in the semi-automatic grinding cycle.

DESCRIPTION OF THE PREFERRED EMBODIMENT

Briefly, the present system provides a new step drill bit grinding process utilizing a modified drill bit pointer e.g. a Winslow Company Type 100-C. The present system, as seen briefly in the block diagram of the FIGURE, includes a laser optical microscope (termed lasermike), a digital readout, a microprocessor, and a stepper motor geared to the workhead stop of the machine. Control over the amounts to be removed from the drill bit is controlled by the microprocessor and not left up to the operator. The operator is merely required to place the step drill bit through the laser beam by utilizing a fixture mounted on the lasermike, thus measuring the pilot diameter which information is coupled to the microprocessor through the digital readout. The microprocessor controls the functions of receiving the signal and analyzing the data from the lasermike and amplifying the signal.

The signal is converted to motion through the power pack and coupled to a stepper motor which produces the required motion to adjust the machine workhead stop. The aforementioned steps require seconds to accomplish; the operator subsequently removes the drill bit from the lasermike station, places it in the workhead of the machine and starts the grinding cycle. During the grinding cycle, the operator places another drill bit in the lasermike station for the next sequence. The microprocessor stores the information until released for the subsequent grinding cycle. As hereinbefore mentioned, the present system, as shown in the FIGURE, includes only three steps in the grinding operation. The modified grinding machine is capable of regrinding step drill at a rate of about 300 per hour and further extending the drill life from four to seven regrinds.

Step drill 8 is positioned in laser optical microscope 10 (e.g. a Model 50, Techmet Co.) and then rotated 360 degrees. The laser optical microscope 10 measures the pilot diameter of step drill 8, remembering only the largest diameter and displaying this value on laser optical microscope readout 12. The data is then transmitted to microprocessor 14 (e.g. Techmet Co. Model No. 82). Microprocessor 14 is pre-programmed to perform various functions but also can be adjusted manually by turning star thumbwheels to desired settings for the various sizes of step drills 8 and further adjusted for the amount of stock to be removed from the pilot diameter of step drill 8. Microprocessor 14 receives the signals from laser optical micrometer 12 and completes the required calculations, thereafter transmitting the signals downstream through power pack 16 to stepper motor 18 (e.g. a Model MO-63-FD09, manufactured by Superior Electric Co.). Stepper motor 18 turns drive shaft 20 which rotates the two bevel gears 22, one vertically, one horizontally. The horizontal gear 22 is threaded internally and rotates around the workhead stop 24 height adjustment shaft. When rotating, horizontal bevel gear 22 moves workhead stop 24 height adjustment shaft up or down. This controls the amount of travel up or down of workhead shaft 26 and workhead 28, so controlling the amount of stock removed from the pilot diameter of step drill 8.

Sony magnascale pickup arm 30 monitors the amount of actual linear movement of workhead stop 24 height adjustment shaft, through magnascale magnetic rod 32, and transmits the information back to (Sony magnascale) digital readout 34 which displays the actual amount of movement in decimal inches (or metric value) made by the workhead stop 24 height adjustment shaft. Digital readout 34 also transmits the information back to microprocessor 14 and, if an error is seen by microprocessor 14, it immediately sends a correcting signal back through power pack 16 to stepper motor 18 to advance or reverse bevel gears 22 which will change the position of workhead stop 24 height adjustment shaft to so correct the error. No grinding of step drill 8 can take place until all movements of the present pilot diameter sensing system have ceased. Step drill 8 is then removed from laser optical micrometer 10 and positioned in workhead 28 and the grinding maching is activated.

The elapsed time required in the aforementioned movements is less than a second.

While step drill 8 is being ground, the next drill is disposed in the laser optical micrometer 10 in readiness. No action will take place until the previous grinding cycle is completed.

It can be seen that the pilot diameter sensing system automates the step drill grinding process by relieving the operator of any guesswork as to the amount of stock to be removed. By setting the aforementioned thumbwheel switches on the front portion of microprocessor 14, an operator can pre-select the amount of grinding to be done. The operator also sets the maximum and minimum diameter allowed on a particular drill size and microprocessor 14 will automatically control the grinding within this set tolerance.

More specifically, the functions of the elements in the block diagram of the FIGURE are described as follows:

1. Lasermike 10

This is a low power helium-neon laser and measures the pilot diameter, remembering only the highest measurement. The measurement is displayed on a digital readout 34. Lasermike 10 further transmits data to microprocessor 14.

2. Microprocessor 14

Microprocessor 14 is a programmable unit that controls stepper motor 18 through power pack 16. Microprocessor 14 receives an input from lasermike 10, does the required calculations, and signals stepper motor 18 to move the workhead stop height or not, accordingly. The processor will also detect out of specification drills and a flashing HI or LO will be displayed.

3. Stepper Motor 18

Stepper mtor 18 replaces the manual GRIND POSITION control that is in the drill bit pointer machine (aforementioned Winslow Company Type 100-C). Stepper motor 18 is connected through a gearing system to the workhead stop height adjustment. Stepper motor 18 receives instructions from microprocessor 14.

4. Digital Readout 34 (Sony Magnascale)

This device measures linear movement. This instrument measures the amount of travel the workhead stop actually makes as instructed by microprocessor 14 and will correct any errors by a signal coupled back to microprocessor 14.

DETAILED INSTRUCTIONS FOR SYSTEM OPERATION

These detailed instructions are included for a clear understanding of the operation of the system embodiment of the FIGURE (some parts referenced to exemplary hardware hereinbefore identified are not shown for simplification).

The purpose of the system of the FIGURE is to classify step drills measured in Model 50 lasermike 10 system and control a grinder to do an amount of sharpening based on the drill's size, minimum allowable size, the desired amount of sharpening, and the current position of the grinder wheel.

The grinder has a movable stop which is controlled by stepper motor 18. Model 82 microprocessor 14 positions stepper motor 18 as a result of calculations on the drill diameter. Stepper motor 18 moves the step 0.00025 inch per step, and the movement is monitored by a Sony position transducer whose BCD output is fed back to Model 82 microprocessor 14 to assure correct positioning.

A relay contact is provided to be inserted in series with the operator's footswitch to prevent the initiation of a grind cycle while stepper motor 18 is in motion. This relay is installed in Model 82 microprocessor 14, and connection to it and the stepper translator box is via an eight terminal barrier strip on the rear of Model 82 microprocessor 14.

Model 82 microprocessor 14 also has provision to monitor two Sony limit switches for upper and lower limit detection. The amplifiers for these sensors are installed in Model 82 microprocessor 14 and connection to them is via J5, the 25 pin EIA connector.

Last, a connector is provided to allow remote actuation of the MEASURE switch.

Turn on Model 82 microprocessor 14. Activate the switch with the up arrow. The motor should turn in the direction that creates an INCREASE in the size of the drill being ground, or a DECREASE in the amount ground off. If not, it is necessary to electrically reverse stepper motor 18, and the method will be found in the section described INTERNAL OPTIONS.

While stepper motor 18 is moving in the increasing size direction, insure that Sony readout 34 is showing an increase in size as well. If not, slide the DIRECTION switch on the rear of Sony readout 34 to its opposite position. Reset the readout via the red RESET switch on the front panel, and verify that the display now shows an increasing size in response to Model 82 microprocessor 14 UP switch.

The remaining Sony switch settings are: RESOLUTION (on left side of readout)=0.0005; IN-MM=IN.

Let stepper motor 18 run in the UP direction until it encounters the upper limit sensor and verify that the Model 82 microprocessor 14 display shows HI END. If it shows LO END, the sensors on the grinder must be reversed.

CONTROLS AND DISPLAY

SETUP

This switch is used to place Model 82 microprocessor 14 into the setup, or calibration, mode. When in this mode, the lamp above this switch will be flashing. Entry into this mode is automatic on application of power or pressing the RES switch. The display will show.

The SETUP mode is also entered automatically on encountering either limit sensor and will be entered also if it takes longer than 12 seconds for stepper motor 18 to get to the correct position. When this occurs, Model 82 microprocessor 14 will show HELP. This will probably be the result of a mechanical problem, but can be caused by the Sony readout switches in the wrong position or being manually reset.

MEASURE

When in the ON position, Model 82 microprocessor 14 accepts size information from lasermike 10, compares it to the largest reading obtained thus far, and if greater, replaces the largest reading. This sequence continues at the update rate of lasermike 10 until the switch is turned off. The maximum reading thus obtained is used to perform classifying and stepper calculations for that drill, or, if in the SETUP mode, is stored as the current position of the grinding wheel against which all future positions of the wheel will be calculated.

While measuring, the lamp above the MEASURE switch will be lit. In the SETUP mode, the lamp flashing above SETUP will come on continuously as soon as the first reading is taken.

MANUAL TURN

These switches are active only in the SETUP mode and will continuously turn stepper motor 18 in either direction. They are to be used for initial positioning of the grinder for grinding the piece to be used for calibration. If a limit is encountered, the switch that causes that direction will be locked out.

Additionally, when the low limit is encountered, the internal relay is actuated to inhibit the grind cycle.

MAX

These three thumbwheel switches are used to set the maximum pilot drill size into Model 82 microprocessor 14. A measurement greater than this will cause the display to flash HI and no grinder movement will occur. The primary purpose of this setting is to catch drills in the wrong batch.

MIN

These switches set the minimum pilot diameter for the batch being run. The range is 0.000 inch to 0.999 inch. The class of drill and the amount ground off are dependent on this setting. A drill measured at less than MIN+0.002 inch (minimum grind) will cause the display to flash LO and no grinder movement will occur.

DIA REM

Selects the amount to be ground off the DIAMETER of the drill, in the range of 0.002 inch to 0.009 inch. The second digit can be activated internally to give a range of 0.002 inch to 0.099 inch, if desired. A setting of zero or one will cause the display to flash on subsequent measurements and no grinder movement will occur. Additionally, if the diameter to be ground is greater than MAX−MIN, an error condition will occur.

CALIBRATION

When the unit is first turned on or reset, it is necessary to recalibrate. The unit is in the calibrate mode when the lamp is flashing above the SETUP switch and the display shows. The manual turn switches are used to position the grinder stop to allow some grinding to occur on a test blank or drill. The amount is not important, as long as some amount is ground off.

The test blank is then removed from the grinder and laid in the the lasermike 10 fixture. When properly positioned in the beam, the MEASURE switch is thrown. The SETUP and MEASURE lamps will then be on continuously. The blank is slowly turned once in the fixture to allow Model 82 microprocessor 14 to capture the largest reading. This is done to keep from measuring across the flutes.

When the MEASURE switch is thrown, the Sony readout 34 will clear to zero. It is not necessary to reset the Sony readout 34 manually, and doing so during operation will require the system to be recalibrated.

After the blank is rotated, but before it is moved further, the MEASURE switch is turned off. If the blank is moved prematurely, an unpredictable high reading may be sent to the processor.

The processor now has a dimension that represents the exact position of the grinder wheel when against the stop, and will base all further stop movement on this reference and the Sony position display.

POSITION

In use, an operator will have dialed in the minimum and maximum step diameters for the current batch, along with the desired amount of diameter removal. The drill is positioned in the beam, and the MEASURE switch, activated. The drill is rotated once against the fixture, taking care that it stays in contact with the fixture. While the MEASURE switch is up, the display will show CL-. After rotation, the measure switch is turned off and the display will show, say, CL-7. At the same time, an internal relay will be activated to disable the grinder footswitch, and stepper motor 18 will position the stop to take a specific amount off of that drill. The drill is placed in the grinder and ground. Then the next drill is measured, etc.

CLASSIFICATION

The class number displayed after the MEASURE switch is turned off is the result of dividing the difference between the reading obtained from lasermike 10 and the MIN switch setting by the DIA REM switch setting. The remainder is dropped. Therefore, a class number represents the number of regrinds remaining on the drill at the current diameter removal setting.

A class of zero means that there is at least 0.002 inch of regrind remaining, but less than the diameter removal setting. In that case, the drill will be ground down to the MIN switch setting size.

ERROR CONDITIONS

There are several errors that can appear to the operator.

| ERROR | | INDICATION |
|---|---|---|
| Size reading is greater than the MAX switch setting. | Flashing | HI |
| Size reading is less than the MIN switch setting + .002 inch. | Flashing | LO |
| The diameter removal switch setting is greater than the difference between the MAX and MIN switch settings. | Flashing | 00 |
| The diameter removal switch setting is less than .002 inch. | Flashing | 01 |
| The calculated class number exceeds 99. | Flashing | CL-99 |
| The lower limit switch has been encountered. | LO END | |
| The upper limit switch has been encountered. | HI END | |
| Twelve seconds of motor travel has failed to properly position the motor. | HELP | |

No stepper motor 18 movement will occur during an error indication.

What is claimed is:

1. In combination in a method for regrinding step drills, the steps including:
   - positioning a step drill in a fixture associated with a laser optical microscope and switching to an ON condition a switch for indicating a diameter measuring process;
   - rotating said step drill through 360° revolution and switching to an OFF condition said switch for initiating a measuring process;
   - removing said step drill from said fixture associated with a laser optical microscope; and, then
   - positioning said step drill in a workhead for activating a grinder
   - adjusting a workshead stop in response to said diameter measuring to control said regrinding of said step drill.

* * * * *